US009169729B2

(12) United States Patent
Xu

(10) Patent No.: US 9,169,729 B2
(45) Date of Patent: Oct. 27, 2015

(54) GAS TURBINE ENGINE TURBINE DIAPHRAGM WITH ANGLED HOLES

(71) Applicant: Solar Turbines Incorporated, San Diego, CA (US)

(72) Inventor: Hongzhou Xu, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 509 days.

(21) Appl. No.: 13/627,946

(22) Filed: Sep. 26, 2012

(65) Prior Publication Data

US 2014/0086727 A1 Mar. 27, 2014

(51) Int. Cl.

| | |
|---|---|
| ***F01D 9/04*** | (2006.01) |
| ***F01D 5/08*** | (2006.01) |
| ***F01D 11/00*** | (2006.01) |
| ***F01D 11/04*** | (2006.01) |

(52) U.S. Cl.

CPC ..... *F01D 5/082* (2013.01); *F01D 5/085* (2013.01); *F01D 9/04* (2013.01); *F01D 11/001* (2013.01); *F01D 11/04* (2013.01); *F05D 2240/128* (2013.01); *F05D 2250/191* (2013.01); *F05D 2260/14* (2013.01); *F05D 2260/201* (2013.01); *F05D 2260/202* (2013.01); *F05D 2260/941* (2013.01); *Y10T 29/49229* (2015.01)

(58) Field of Classification Search

CPC ..... F01D 9/02; F01D 9/04; F01D 25/12; F05D 2240/128; F05D 2260/201; F05D 2260/202

USPC ..... 415/191, 199.5, 211.2

See application file for complete search history.

(56) References Cited

U.S. PATENT DOCUMENTS

| | | | | |
|---|---|---|---|---|
| 3,791,758 | A * | 2/1974 | Jenkinson | 415/116 |
| 4,113,406 | A | 9/1978 | Lee et al. | |
| 4,178,129 | A * | 12/1979 | Jenkinson | 416/95 |
| 4,469,470 | A * | 9/1984 | Geary | 415/115 |
| 4,674,955 | A | 6/1987 | Howe et al. | |
| 5,984,630 | A | 11/1999 | Di Salle et al. | |
| 7,090,461 | B2 * | 8/2006 | Liang | 415/115 |
| 7,341,429 | B2 | 3/2008 | Montgomery et al. | |
| 7,950,897 | B2 | 5/2011 | Kizuka et al. | |
| 8,381,533 | B2 * | 2/2013 | Smoke et al. | 60/806 |
| 2007/0271930 | A1 | 11/2007 | Takaoka et al. | |
| 2010/0275612 | A1 | 11/2010 | Smoke et al. | |
| 2011/0247347 | A1 * | 10/2011 | Ebert et al. | 60/806 |
| 2011/0274536 | A1 | 11/2011 | Inomata et al. | |

* cited by examiner

*Primary Examiner* — Ninh H Nguyen

(74) *Attorney, Agent, or Firm* — Procopio, Cory, Hargreaves & Savitch LLP

(57) ABSTRACT

A gas turbine engine turbine diaphragm (460) includes an inner cylindrical portion (461), a mounting portion (463), and a disk portion (462). The mounting portion (463) is located radially outward from the inner cylindrical portion (461). The disk portion (462) extends radially between the inner cylindrical portion (461) and the mounting portion (463). The disk portion (462) includes a plurality of angled holes (464). Each angled hole (464) follows a vector which is angled in at least one plane. A component of the vector is located on a plane perpendicular to a radial extending from an axis of the diaphragm (460). The component of the vector is angled relative to an axial direction of the diaphragm (460).

19 Claims, 5 Drawing Sheets

GAS TURBINE ENGINE TURBINE DIAPHRAGM WITH ANGLED HOLES

TECHNICAL FIELD

The present disclosure generally pertains to gas turbine engines, and is more particularly directed toward a turbine diaphragm with angled holes configured for cooling downstream components.

BACKGROUND

Gas turbine engines include compressor, combustor, and turbine sections. Portions of a gas turbine engine are subject to high temperatures. In particular, the turbine section is subject to such high temperatures that the first stages are cooled by air directed through internal cooling passages from the compressor. The use of air from the compressor for cooling may reduce the efficiency of the gas turbine engine. Loss or uncontrolled cooling air leakage may also lead to a loss of efficiency and may lead to improper cooling.

U.S. patent Application Publication No. 2011-0274536 to A. Inomata discloses a steam turbine where a diaphragm-side cooling path is formed through the internal diaphragm in the axial direction of the rotor and a cooling medium flowing through the rotor-side cooling path diverts into the diaphragm-side cooling path and a labyrinth flow path provided between the internal diaphragm and the rotor.

The present disclosure is directed toward overcoming one or more of the problems discovered by the inventors.

SUMMARY OF THE DISCLOSURE

A gas turbine engine turbine diaphragm includes an inner cylindrical portion, a mounting portion, and a disk portion. The mounting portion is located radially outward from the inner cylindrical portion. The disk portion extends radially between the inner cylindrical portion and the mounting portion. The disk portion includes a plurality of angled holes. Each angled hole follows a vector which is angled in at least one plane. A component of the vector is located on a plane perpendicular to a radial extending from an axis of the diaphragm. The component of the vector is angled relative to an axial direction of the diaphragm.

DETAILED DESCRIPTION

The systems and methods disclosed herein include a gas turbine engine diaphragm with angled holes. In embodiments, the diaphragm may be configured to provide a predictable amount of cooling air to the adjacent turbine disk located aft of the diaphragm. The angled holes can be configured to swirl cooling air such that the angular velocity of the cooling air matches the angular velocity of the adjacent turbine disk.

Matching the angular velocity of the cooling air with the angular velocity of the adjacent turbine disk can reduce the temperature of the adjacent turbine disk, which can result in a longer service life of the adjacent turbine disk.

Figure 1:
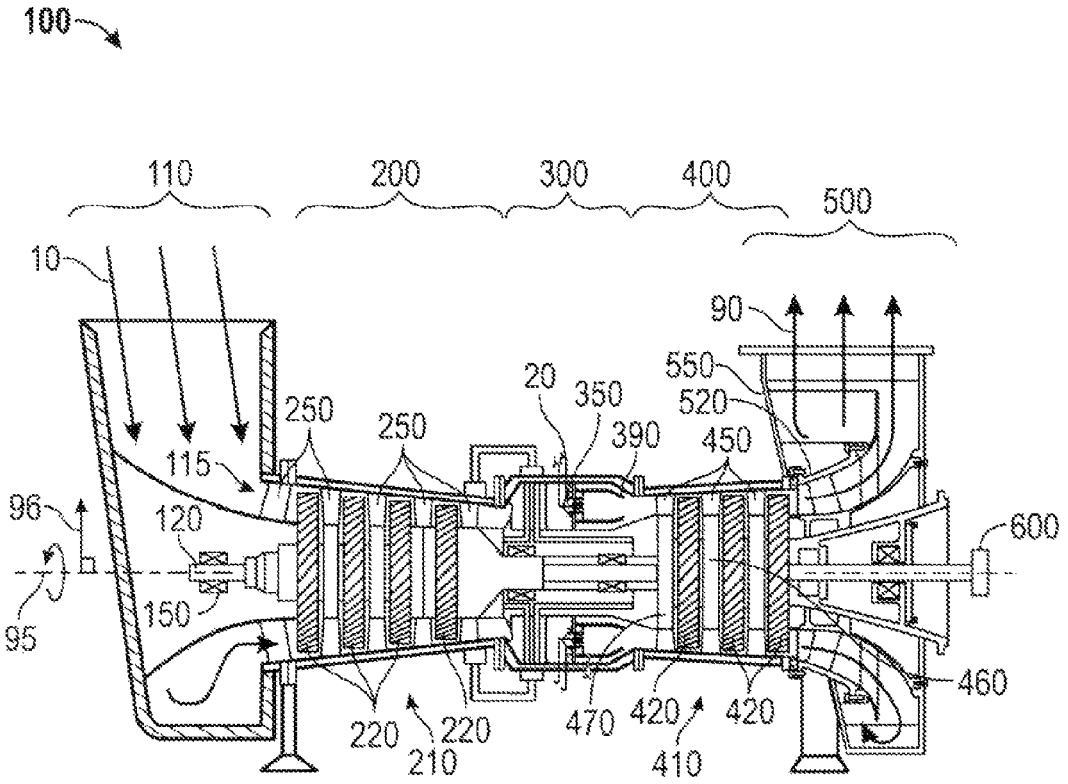
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or "compressor" 200, a combustor 300, a turbine 400, an exhaust 500, and a power output coupling 600. The gas turbine engine 100 may have a single shaft or a dual shaft configuration.

The compressor 200 includes a compressor rotor assembly 210 and compressor stationary vanes ("stators") 250. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially precede each of the compressor disk assemblies 220. Each compressor disk assembly 220 paired with the adjacent stators 250 that precede the compressor disk assembly 220 is considered a compressor stage. Compressor 200 includes multiple compressor stages.

The combustor 300 includes one or more injectors 350 and includes one or more combustion chambers 390.

The turbine 400 includes a turbine rotor assembly 410, turbine nozzles 450, and one or more turbine diaphragms 460. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk 430 (shown in FIG. 2) that is circumferentially populated with turbine blades 440 (shown in FIG. 2). Turbine nozzles 450 axially precede each of the turbine disk assemblies 420. The turbine diaphragm 460 may support turbine nozzles 450 and may be located radially inward from turbine nozzles 450. Each turbine disk assembly 420 paired with the adjacent turbine nozzles 450 that precede the turbine disk assembly 420 is considered a turbine stage. Turbine 400 includes multiple turbine stages.

The exhaust 500 includes art exhaust diffuser 520 and an exhaust collector 550.

Figure 2:
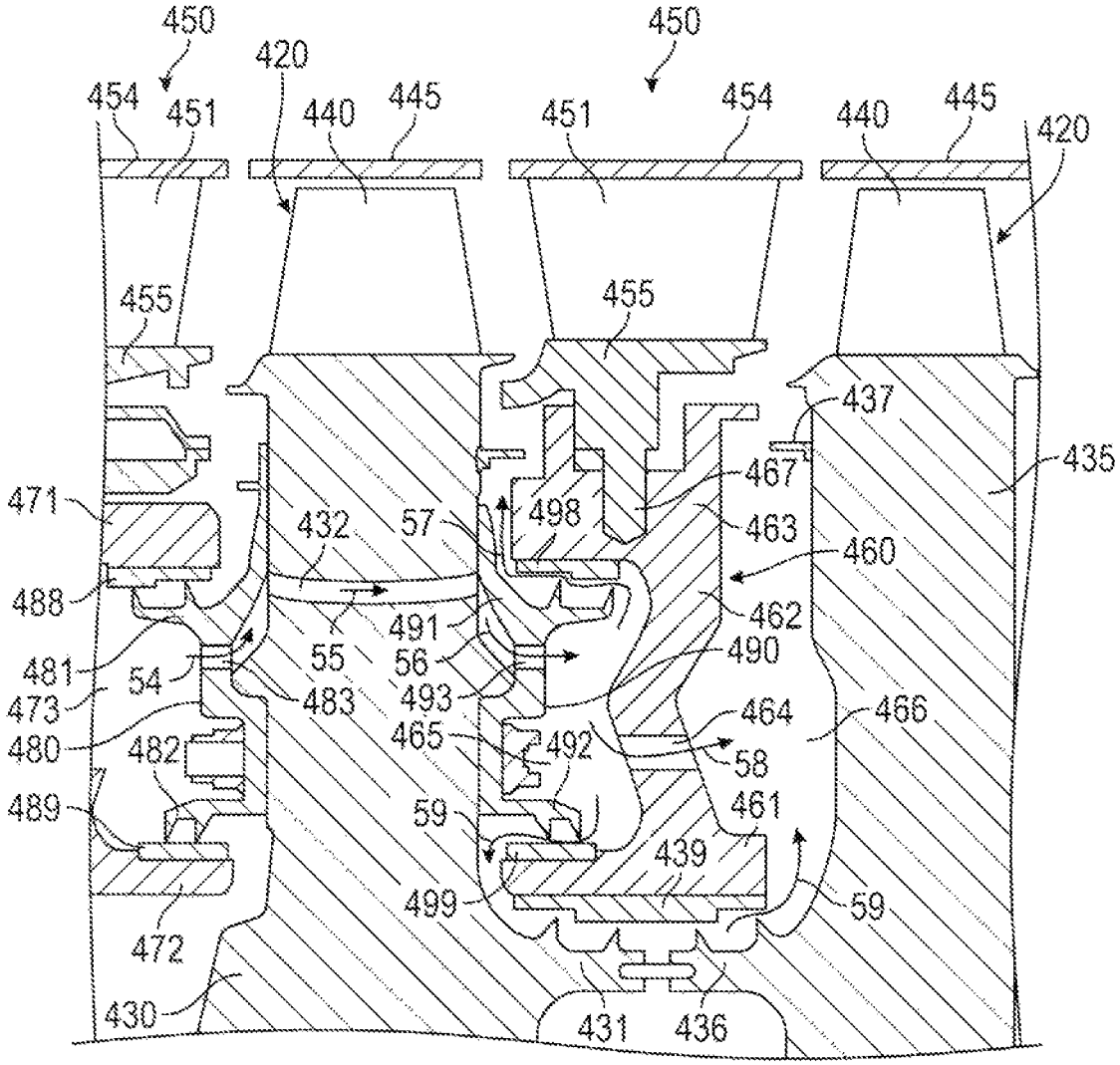
FIG. 2 is a cross-sectional view of a portion of a gas turbine engine turbine.
Figure 3:
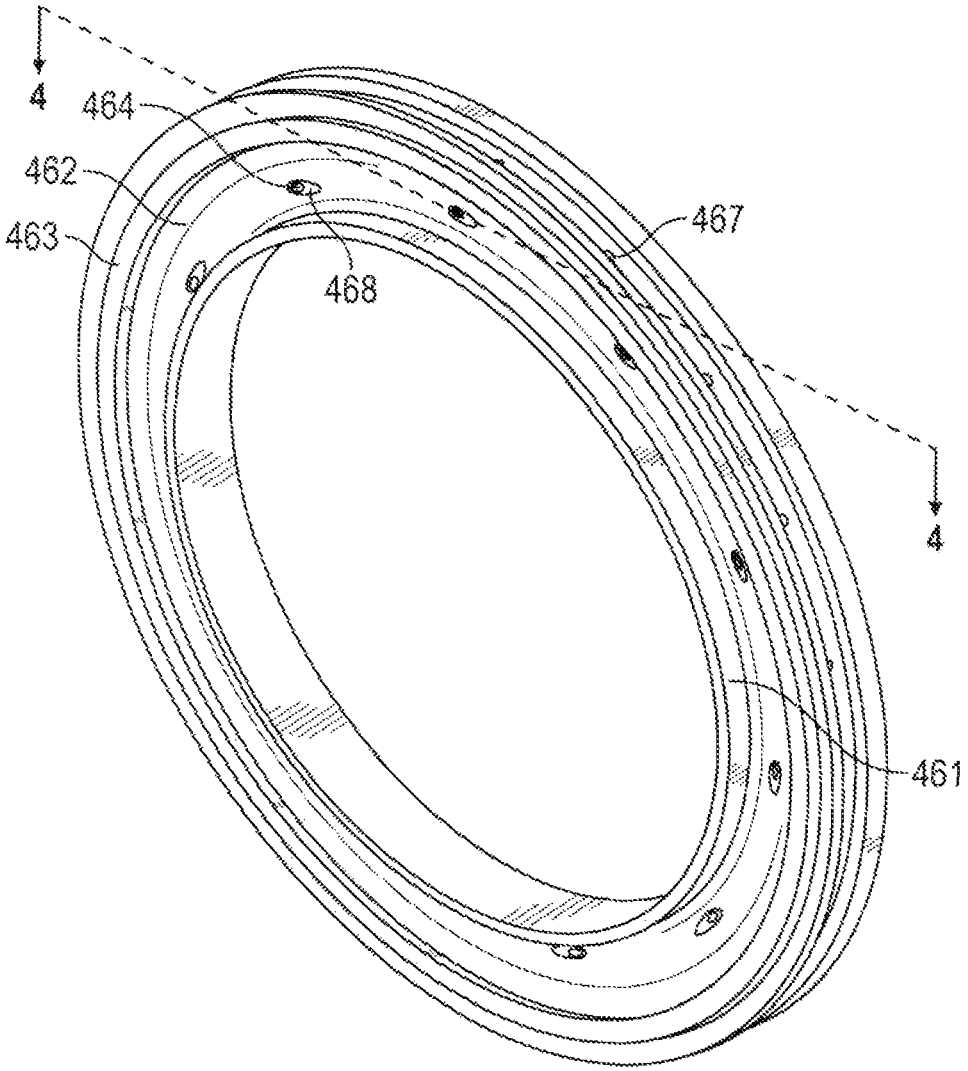
FIG. 3 is a perspective view of a turbine diaphragm.

FIG. 2 is a cross-sectional view of a portion of the turbine 400 of FIG. 1. FIG. 3 is a perspective view of a turbine diaphragm 460. The diaphragm of FIG. 3 may be used in the gas turbine engine 100 of FIG. 1. As previously mentioned and illustrated in FIG. 2, the turbine 400 includes turbine diaphragm 460, turbine nozzles 450, and turbine rotor assembly 410 (shown in FIG. 1). All references to radial, axial, and circumferential directions and measures for elements of turbine diaphragm 460 refer to the axis of turbine diaphragm 460, which is concentric to center axis 95. The axial direction 99 (illustrated in FIG. 4) of the turbine diaphragm 460 is the direction traveling from the forward or upstream side of the turbine diaphragm 460 to the aft or downstream side of the turbine diaphragm 460 along a path concentric or parallel to the axis of the turbine diaphragm 460.

Referring to FIGS. 2 and 3, turbine diaphragm 460 may include inner cylindrical portion 461, disk portion 462, and mounting portion 463. Inner cylindrical portion 461 may be in the form of a hollow circular cylinder with a variable thickness, defining a bore there within. Mounting portion 463 may be a circular piece and may be located radially outward from inner cylindrical portion 461. As shown in FIG. 2, mounting portion 463 may be located radially inward from turbine nozzles 450 and may be configured to couple with turbine nozzles 450. Mounting portion 463 may include mounting holes 467 as illustrated in FIG. 3.

Disk portion 462 may extend radially between inner cylindrical portion 461 and mounting portion 463. Disk portion 462 may also extend axially forward and axially aft while spanning radially between inner cylindrical portion 461 and mounting portion 463. Disk portion 462 may also have a variable thickness. In the embodiment shown in FIG. 3, inner cylindrical portion 461, disk portion 462, and mounting portion 463 circumferentially extends completely around the axis of the diaphragm. Inner cylindrical portion 461, mounting portion 463, and disk portion 462 may be configured to form a first cavity 465 located axially forward of disk portion 462 as shown in FIG. 2.

Figure 4:
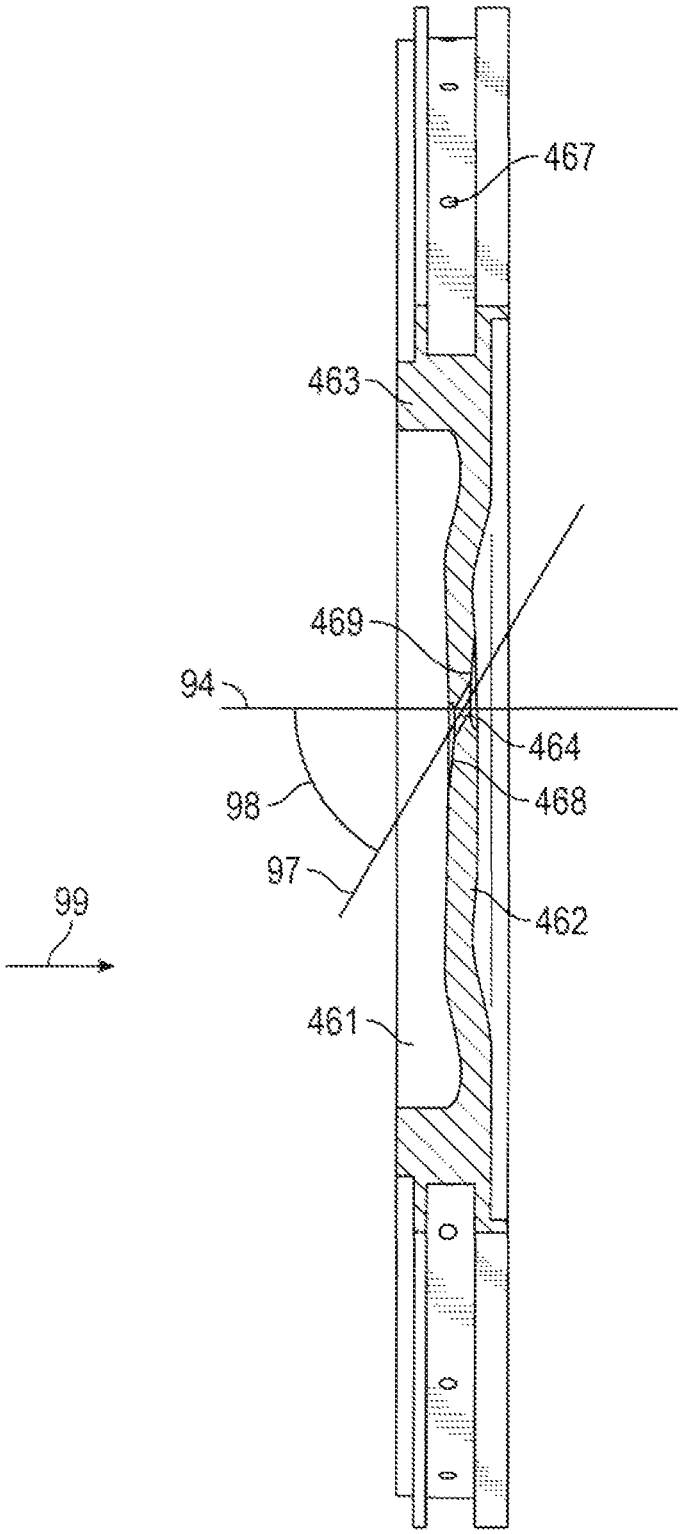
FIG. 4 is a cross-sectional view the turbine diaphragm of FIG. 3 taken along line 4-4 with a direction of sight indicated by the arrows.

Turbine diaphragm 460 is configured to include angled holes 464, and may also include first stress relief region 468 (illustrated in FIGS. 3 and 4) and second stress relief region 469 (shown in FIG. 4). In the embodiment shown in FIGS. 2 and 3, angled holes 464 are formed in disk portion 462. In one embodiment, turbine diaphragm 460 includes from five to twenty angled holes 464. In the embodiment shown in FIG. 3, turbine diaphragm 460 is configured to include eleven angled holes 464.

The diameter of angled holes 464 may be sized based on the cooling flow needed. In one embodiment, the diameter of each angled hole 464 taken at a cross-section normal to the angled hole 464 is ⅛" to 3/16". In another embodiment, the diameter of each angled hole 464 taken at a cross-section normal to the angled hole 464 is ¼".

Referring now to FIG. 2, each turbine nozzle 450 includes an outer wall 454, an inner wall 455, and a nozzle blade 451. Each outer wall 454 has an arcuate shape and connects to the turbine housing (not shown). An inner wall 455 is located radially inward from outer wall 454. Each inner wall 455 has an arcuate shape and may connect to turbine diaphragm 460 at mounting portion 463. One or more nozzle blades 451 span between outer wall 454 and inner wall 455.

Turbine rotor assembly 410 includes multiple turbine disk assemblies 420 joined together. A turbine disk assembly 420 is axially forward of turbine diaphragm 460 and includes first turbine disk 430 with multiple turbine blades 440. Another turbine disk assembly 420 is axially aft of turbine diaphragm 460 and includes second turbine disk 435 with multiple turbine blades 440. First turbine disk 430 and second turbine disk 435 may be configured with a bore (not shown) for coupling to shaft 120 (shown in FIG. 1). First turbine disk 430 includes disk boles 432. The first cavity 465 may be bound by an aft facing surface of first turbine disk 430. Second turbine disk 435 may include a disk-post and dampers 437 (only one shown in FIG. 2). Dampers 437 are located near the radial outer edge of second disk 435. A portion of dampers 437 may be on an axially forward facing surface of second turbine disk 435. The axially forward facing surface of second turbine disk 435 and turbine diaphragm 460 define a second cavity 466.

First turbine disk 430 may also include first labyrinth threads 431 extending axially all and radially outward. Second turbine disk 435 may include second labyrinth threads 436 extending axially forward and radially outward. The second labyrinth threads 436 may be located axially aft of the first labyrinth threads 431. Both first labyrinth threads 431 and second labyrinth threads 436 may be located radially inward of turbine diaphragm 460. Bore running surface 439 may be located radially inward of and radially adjacent to turbine diaphragm 460 and may be within the bore of turbine diaphragm 460. In the embodiment shown in FIG. 2, first labyrinth threads 431, second labyrinth threads 436, and bore running surface 439 form a labyrinth seal within the bore of turbine diaphragm 460.

Turbine blades 440 may be installed axially or circumferentially onto first turbine disk 430 and second turbine disk 435. Turbine 400 also includes shrouds 445 located radially outward and spaced apart from turbine blades 440. Shrouds 445 may attach to the turbine housing (not shown).

The turbine 400 may also include a forward diaphragm 470, a preswirler (not shown), a forward labyrinth seal 480, and an aft labyrinth seal 490. The forward diaphragm 470 is located axially forward of first turbine disk 430. Forward diaphragm 470 may also be configured to couple with turbine nozzles 450. The preswirler may be located within a third cavity 473 formed in forward diaphragm 470 between radial outer portion 471 of forward diaphragm 470 and radial inner portion 472 of forward diaphragm 470. The axially aft end of die third cavity 473 may be bound by the axially forward facing surface of first turbine disk 430.

Forward labyrinth seal 480 may be located within third cavity 473 between forward diaphragm 470 and first turbine disk 430. Forward labyrinth seal 480 may be coupled to first turbine disk 430 at the forward axial face of first turbine disk 430. Forward labyrinth seal 480 includes forward outer labyrinth threads 481, forward inner labyrinth threads 482, forward labyrinth hole 483, forward outer running surface 488, and forward inner running surface 489. Forward outer running surface 488 may be adjacent outer portion 471 and forward outer labyrinth threads 481. Forward outer running surface 488 may be radially inward from outer portion 471 and radially outward from forward outer labyrinth threads 481. Forward inner running surface 489 may be adjacent inner portion 472 and forward inner labyrinth threads 482. Forward inner running surface 489 may be located radially outward from inner portion 472 and radially inward from forward inner labyrinth threads 482.

Aft labyrinth seal 490 may be located within first cavity 465 between turbine diaphragm 460 and first turbine disk 430. Aft labyrinth seal 490 may be coupled to first turbine disk 430 at the aft axial face of first turbine disk 430. Aft labyrinth seal 490 includes aft outer labyrinth threads 491, aft inner labyrinth threads 492, aft labyrinth hole 493, aft outer running surface 498, and aft inner running surface 499. Aft outer running surface 498 may be adjacent mounting portion 463 and aft outer labyrinth threads 491. Aft outer running surface 498 may be radially inward from mounting portion 463 and radially outward from aft outer labyrinth threads 491. Aft inner running surface 499 may be adjacent inner cylindrical portion 461 and aft inner labyrinth threads 492. Aft inner running surface 499 may be located radially outward from cylindrical portion 461 and radially inward from aft inner labyrinth threads 492.

In the embodiment depicted in FIG. 2, forward diaphragm 470 is a first stage diaphragm, first turbine disk 430 is a first stage turbine disk, turbine diaphragm 460 is a second stage diaphragm, and second turbine disk 435 is a second stage turbine disk.

FIG. 4 is a cross-sectional view the turbine diaphragm 460 shown in FIG. 3. The turbine diaphragm 460 may be used in the gas turbine engine 100 of FIG. 1. As previously mentioned, turbine diaphragm 460 may be configured to include angled holes 464. Angled holes 464 may follow a vector which is angled in at least one plane. A component of this vector, line 97, may be located on a plane perpendicular to a radial extending from the axis of the turbine diaphragm 460 and may be angled relative to the axial direction 99 of the turbine diaphragm 460 illustrated by angle 98, the angle between lines 94 and 97 in FIG. 4. The radial may be radial 96 (illustrated in FIG. 1). Line 94 is a reference line located on the plane perpendicular to the radial extending from the axis of the diaphragm 460 and is oriented in axial direction 99. Line 97 may also be angled towards the second turbine disk 435 rotational direction so that angled holes 464 may direct the gas or air in the same rotational direction as the second turbine disk 435.

In one embodiment, angle 98 is from twenty to eighty-five degrees. In another embodiment, angle 98 is from fifty to seventy degrees. In another embodiment, angle 98 is sixty degrees.

A first stress relief region 468 may be formed contiguous each angled hole 464. Each first stress relief region 468 is in flow communication with the angled hole 464. Each first stress relief region 468 may be an elongated recess and may recede into turbine diaphragm 460 thereby widening the opening of the angled hole 464. Each first stress relief region 468 may have an angle similar to the angle of the contiguous angled hole 464. Each first stress relief region 468 may have a curved profile and may include multiple curves, arcs, or radii. Each first stress relief region 468 may be an elongated scoop. The scoop may be wider than the diameter of angled holes 464. The elongated length of the scoop may be biased away from the contiguous angled hole 464 along line 97, as illustrated in FIG. 4. In one embodiment, each first stress relief region 468 is located upstream of an angled hole 464 and recedes axially aft into turbine diaphragm 460. In another embodiment, each first stress relief region 468 is located downstream of an angled hole 464 and recedes axially forward into turbine diaphragm 460.

A second stress relief region 469 may be formed contiguous each angled hole 464. Each second stress relief region 469 is in flow communication with the angled hole 464. Each second stress relief region 469 may be an elongated recess and may recede into turbine diaphragm 460 thereby widening the opening of the angled hole 464. Each second stress relief region 469 may have an angle similar to the angle of the contiguous angled hole 464. Each second stress relief region 469 may have a curved profile and may include multiple curves, arcs, or radii. Each second stress relief region 469 may be an elongated scoop. The scoop may be wider than the diameter of angled holes 464. The elongated length of the scoop may be biased away from the contiguous angled hole 464 along line 97, as illustrated in FIG. 4. In one embodiment, each second stress relief region 469 is located downstream of an angled hole 464 opposite an upstream first stress relief region 468. The second stress relief region 469 recedes axially forward into turbine diaphragm 460. In another embodiment, each second stress relief region 469 is located upstream of an angled hole 464 opposite a downstream first stress relief region 468. The second stress relief region 469 recedes axially aft into turbine diaphragm 460.

Each first stress relief region 468 and second stress relief region 469 may be formed by manufacturing processes such as ball milling, electrical discharge machining, or drilling.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Industrial Applicability

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction going from the inlet 110 towards the exhaust 500). Likewise, each turbine disk assembly 420 may be associated with a numbered stage.

Once compressed air 10 leaves the compressor 200, it enters the combustor 300, where it is diffused and fuel 20 is added. Air 10 and fuel 20 are injected into the combustion chamber 390 via injector 350 and ignited. After the combustion reaction, energy is then extracted from the combusted fuel/air mixture via the turbine 400 by each stage of the series of turbine disk assemblies 420. Exhaust gas 90 may then be diffused in exhaust diffuser 520 and collected, redirected, and exit the system via an exhaust collector 550. Exhaust gas 90 may also be further processed (e.g., to reduce harmful emissions, and/or to recover heat from the exhaust gas 90).

Operating efficiency of a gas turbine engine generally increases with a higher combustion temperature. Thus, there is a trend in gas turbine engines to increase the temperatures. Gas reaching forward stages of a turbine from a combustion chamber may be 1000 degrees Fahrenheit or more. To operate at such high temperatures a portion of compressed air of a compressor of a gas turbine engine may be diverted through internal passages or chambers to cool various components of a turbine such as disk-posts, dampers, and turbine disks.

Gas reaching forward stages of a turbine may also be under high pressure. Cooling air diverted from a compressor may need to be at compressor discharge pressure to effectively cool turbine components located in forward stages of a turbine. Gas turbine engine 100 components such as second turbine disk 435, damper 437, and disk-posts (not shown) may be subject to elevated levels of stress.

Cooling air with a substantially axial flow is diverted from the compressor discharge. deferring to FIG. 2, the cooling air from the compressor discharge may pass through forward diaphragm 470 and a preswirler (not shown) to the path for cooling air 54. Compressor discharge air may exit the pre-swirler with a tangential component that may match the angular velocity of first turbine disk 430. Cooling air may travel along path for coo ling air 54 from third cavity 473, through forward labyrinth hole 483 of forward labyrinth seal 480, and into first turbine disk 430 and to path for cooling air 55.

Path for cooling air 55 may pass axially through first turbine disk 430 along disk holes 432. A portion of the cooling air may be diverted radially outward to cool turbine blades 440 that circumferentially surround first turbine disk 430. The remainder of the cooling air may continue along path for cooling air 55 and exits disk holes 432 on the aft side of first turbine disk 430 to path for cooling air 56. Path for cooling air 56 may pass through aft labyrinth hole 493 and into first cavity 465. While a particular path along paths for cooling air 54, 55, and 56 has been described, alternate paths from the compressor discharge to first cavity 465 may be used.

It was determined through research and testing that cooling air from the compressor discharge may be directed to the second cavity 466 to cool the second turbine disk 435, dampers 437, and the disk-posts. Cooling air from the compressor discharge entering first cavity 465 may exit first cavity 465 and travel to second cavity 466 along path for cooling air 59. A portion of the cooling air may also travel along path for cooling air 57 radially outward towards a gap between a radial outer edge of first turbine disk 430 and inner wall 455.

Cooling air following path for cooling air 59 may pass through aft labyrinth seal 490 between aft inner labyrinth threads 492 and aft inner running surface 499, as well as a labyrinth seal formed by first labyrinth threads 431, second labyrinth threads 436, and bore running surface 439. As turbine 400 heats up or cools down the distance between aft inner labyrinth threads 492 and aft inner running surface 499, as well as the distance between first labyrinth threads 431 and bore running surface 439, and the distance between second labyrinth threads 436 and bore running surface 439 may increase or decrease due to thermal expansion. These variable distances may provide uncontrolled amounts of compressor discharge cooling air to second cavity 466. An uncontrolled amount of cooling air may lead to improper or insufficient cooling of second turbine disk 435, dampers 437, and the disk-posts.

It was further determined that angled holes 464 may provide a controlled flow of cooling air to second cavity 466 to cool second turbine disk 435, dampers 437, and disk-posts. Cooling air traveling along path for cooling air 59 may be minimized by reducing the gaps between aft inner labyrinth threads 492 and aft inner running surface 499, first labyrinth threads 431 and bore running surface 439, and second labyrinth threads 436 and bore running surface 439. Alternative seals reducing the flow of cooling air along path for cooling air 59 may also be used.

While a portion of the cooling air may travel along path for cooling air 59, angled holes 464 may be configured such that a majority of the cooling air traveling from first cavity 465 to second cavity 466 may travel along path for cooling air 58, which travels through turbine diaphragm 460 along angled holes 464. With the use of angled holes 464 the amount of cooling air passing from first cavity 465 to second cavity 466 may be predicted. Angled holes 464 may not be as sensitive to thermal expansion as the labyrinth seals and may provide a more stable flow of cooling air to second cavity 466. In one embodiment, fifty to one-hundred percent of the cooling air travels along path for cooling air 58 and zero to fifty percent of the cooling air travels along path for cooling air 59. In another embodiment, fifty to seventy percent of the cooling air travels along path for cooling air 58 and thirty to fifty percent of the cooling air travels along path for cooling air 59. In another embodiment, fifty-five to sixty-five percent of the cooling air travels along path for cooling air 58 and thirty-five to forty-five percent of the cooling air travels along path for cooling aft 59. In another embodiment, approximately sixty-two percent of the cooling air travels along path tor cooling air 58 and approximately thirty-eight percent of the cooling air travels along path for cooling air 59.

Path for cooling air 58 through angled holes 464 is much shorter and less tortuous than path for cooling air 59 through aft labyrinth seal 490 and the labyrinth seal formed by first labyrinth threads 431, second labyrinth threads 436, and bore running surface 439. The longer, more tortuous path for cooling air 59 may result in an increase in temperature, as the cooling air may be in contact with hot gas turbine engine components for a longer time period prior to reaching second cavity 466. A pressure drop in the cooling air may also occur due to the length and tortuous path of path for cooling air 59. The temperature increase and pressure drop may reduce the effectiveness of the cooling air. Directing cooling air through path for cooling air 58 may result in more effective cooling and may result in an increase in gas turbine engine efficiency.

Angled holes 464 may be configured to direct cooling air into second cavity 466 with an angular velocity that matches the angular velocity of second turbine disk 435. A matching angular velocity between the cooling air and second turbine disk 435 may reduce metal temperatures of the second turbine disk 435, dampers 437, and the disk-posts, which can result in extending the turbine field service life of the second disk 435 and dampers 437.

Directing the cooling air with angled holes 464 may lead to increased stress in regions of turbine diaphragm 460. It was determined that first stress relief region 468 and second stress relief region 469 may reduce stress concentrations in turbine diaphragm 460. The use of angled holes 464 may lead to longer service life hours tor second turbine disk 435, dampers 437, and the disk-posts, as well as an efficient use of the cooling air bled from compressor 200.

Figure 5:
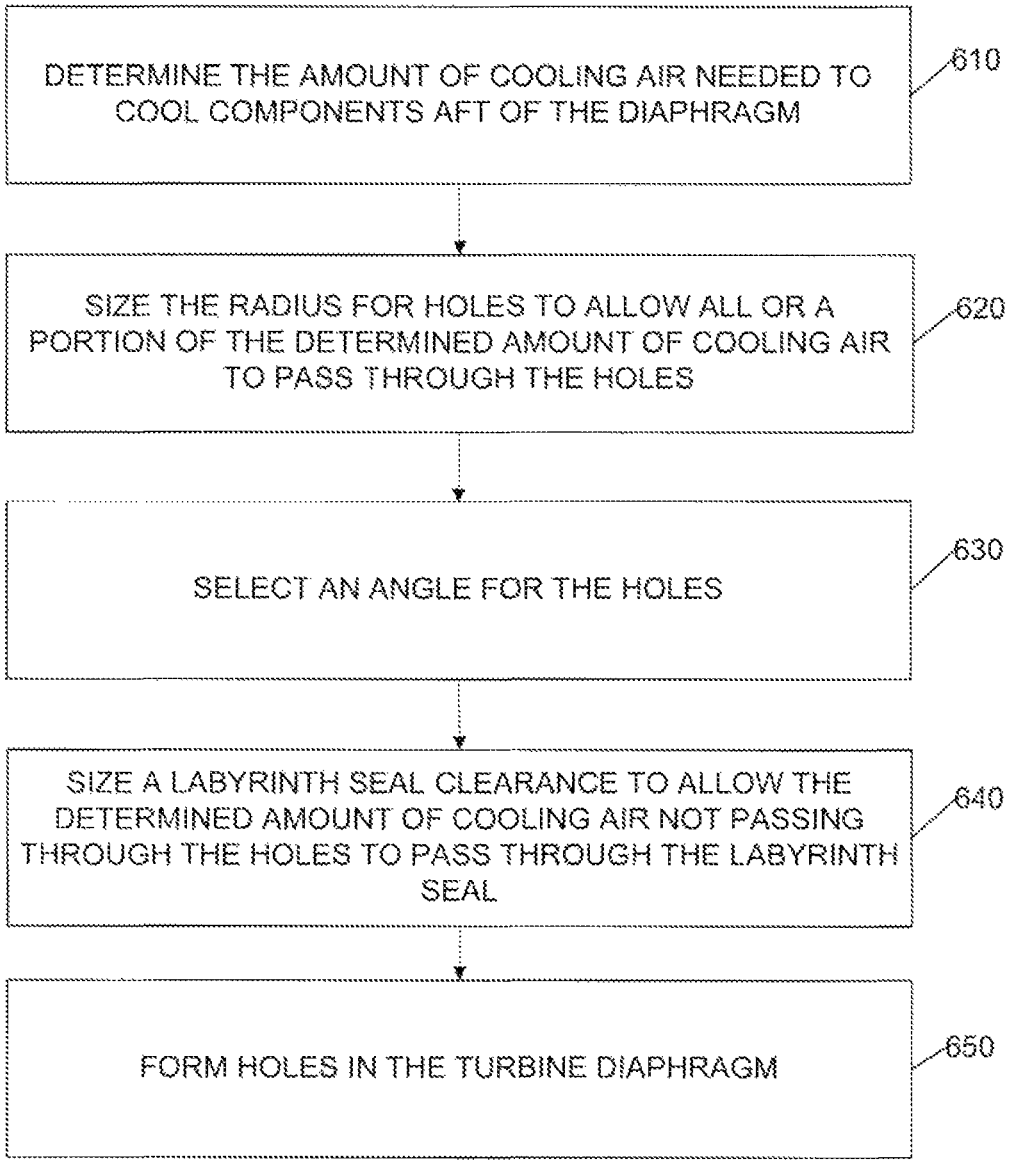
FIG. 5 is a flowchart of a method for forming angled holes in a turbine diaphragm.

FIG. 5 is a flowchart of a method for forming angled cooling holes in a turbine diaphragm. The method includes determining the amount of cooling air needed to cool components aft of the turbine diaphragm 460 at step 610. The components aft of the turbine diaphragm 460 may include the second turbine disk 435, dampers 437, and the disk-posts. Step 610 is followed by sizing the radius for the holes to allow all or a portion of the determined amount of cooling air to pass through the holes at step 620. Step 620 may be partially based on the allowable downstream disk stress requirements. The downstream disk may be second turbine disk 435 (shown in FIG. 2). Step 620 may be followed by selecting an angle for the holes at step 630. The angle of the holes may be selected by starting with straight holes, the axis of each hole being in the axial direction 99 of the turbine diaphragm and skewing the axis of each hole toward the rotational direction as much as possible under the condition of satisfying all mechanical design requirements.

Step 630 is followed by sizing a labyrinth seal clearance to allow the determined amount of cooling air not passing through the angled holes to pass through the labyrinth seal at step 640. The labyrinth seal clearance may be for aft labyrinth seal 490 and the labyrinth seal formed by first labyrinth threads 431, second labyrinth threads 436, and bore running surface 439 (shown in FIG. 2). Step 640 may be followed by performing an engine test validation at step 645.

The method also includes forming holes in a turbine diaphragm with the selected radius and with the selected angle at step 650. The holes formed at step 650 may be angled holes 464. In one embodiment step 650 is completed by drilling.

It is understood that the steps disclosed herein (or parts thereof) may be performed in the order presented or out of the order presented, unless specified otherwise. For example, step 620 may be performed before, after, or concurrently with step 630.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes particular diaphragms and associated processes, it will be appreciated that other diaphragms and processes in accordance with this disclosure can be implemented in various other turbine stages, configurations, and types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A gas turbine engine turbine diaphragm, comprising:
- an inner cylindrical portion;
- a mounting portion located radially outward from the inner cylindrical portion; and
- a disk portion extending radially between the inner cylindrical portion and the mounting portion, the disk portion having
  - a plurality of angled holes, each angled hole following a vector which is angled in at least one plane with a component of the vector being located on a plane perpendicular to a radial extending from an axis of the diaphragm, the component of the vector being angled relative to an axial direction of the diaphragm; and
  - a plurality of first stress relief regions, each first stress relief region being contiguous to one of the plurality of angled holes with each first stress relief region having a curved and an elongated profile, the first stress relief region being wider than a diameter of the one of the plurality of angled holes.

2. The diaphragm of claim 1, wherein the disk portion further includes a plurality of second stress relief regions, each second stress relief region being contiguous to one of the plurality of angled holes with each second stress relief region having a curved and an elongated profile, the elongated profile being wider than the diameter of the angled hole.

3. The diaphragm of claim 2, wherein each angled hole is configured to be in flow communication with one of the plurality of first stress relief regions and one of the plurality of second stress relief regions, and is configured to be downstream of the one of the plurality of first stress relief regions and upstream of the one of the plurality of second stress relief regions.

4. The diaphragm of claim 1, wherein each angled hole is configured to be in flow communication with and downstream of one of the plurality of first stress relief regions.

5. The diaphragm of claim 1, wherein each angled hole is configured to be in flow communication with and upstream of one of the plurality of first stress relief regions.

6. The diaphragm of claim 1, wherein the component of the vector is angled from twenty to eighty-five degrees relative to the axial direction of the diaphragm.

7. The diaphragm of claim 1, wherein the component of the vector is angled sixty degrees relative to the axial direction of the diaphragm.

8. A gas turbine engine including the diaphragm of claim 1.

9. A gas turbine engine including the diaphragm of claim 1, further comprising:
- a first turbine disk having
  - a plurality of disk holes; and
- a second turbine disk having
  - a damper, and
  - a disk-post;
- wherein the diaphragm is located axially aft of the first turbine disk and axially forward of the second turbine disk.

10. A gas turbine engine including the diaphragm of claim 1, further comprising:
- a first turbine disk having
  - a plurality of disk holes, and
  - first labyrinth threads extending axially aft and radially outward;
- a second turbine disk having
  - a damper,
  - a disk-post, and
  - second labyrinth threads extending axially forward and radially outward; and
- the diaphragm having
  - the inner cylindrical portion being configured with a bore;
- a first cavity located between the first turbine disk and the diaphragm;
- a second cavity located between the diaphragm and the second turbine disk; and
- a bore running surface located radially inward of the cylindrical portion within the bore;
- wherein the first labyrinth threads, the second labyrinth threads, and the bore running surface form a labyrinth seal.

11. A gas turbine engine including the diaphragm of claim 1, wherein the angled holes are configured to impart an angular velocity to cooling air that matches an angular velocity of a turbine disk.

12. A gas turbine engine including the diaphragm of claim 1, wherein from fifty to one-hundred percent of cooling air travels from a first cavity to a second cavity through the angled holes and from zero to fifty percent of the cooling air travels from the first cavity to the second cavity through a labyrinth seal.

13. A gas turbine engine turbine diaphragm, comprising:
- an inner cylindrical portion;
- a mounting portion located radially outward from the inner cylindrical portion; and
- a disk portion extending radially between the inner cylindrical portion and the mounting portion, the disk portion having
  - a plurality of angled holes, each angled hole following a vector which is angled in at least one plane with a component of the vector being located on a plane perpendicular to a radial extending from an axis of the diaphragm, the component of the vector being angled from fifty to seventy degrees relative to an axial direction of the diaphragm; and
  - a plurality of first stress relief regions, each stress relief region being contiguous to one of the plurality of angled holes with each first stress relief region having an elongated scoop shape, the elongated scoop shape being wider than a diameter of the contiguous angled hole and biased away from the contiguous angled hole along the component of the vector.

14. The diaphragm of claim 13, wherein the disk portion further includes a plurality of second stress relief regions, each second stress relief region being contiguous to one of the plurality of angled holes with each second stress relief region having an elongated scoop shape, the elongated scoop shape being wider than a diameter of the contiguous angled hole and biased away from the contiguous angled hole along the component of the vector.

15. The diaphragm of claim 13, wherein each first stress relief region is configured to be in flow communication with the contiguous angled hole and upstream of the contiguous angled hole.

16. The diaphragm of claim 15, wherein each second stress relief region is configured to be in flow communication with the contiguous angled hole and is configured to be downstream of the contiguous angled hole.

17. The diaphragm of claim 13, wherein each first stress relief region is configured to be in flow communication with contiguous angled hole and downstream of the contiguous angled hole.

18. A gas turbine engine including the diaphragm of claim 13.

19. A method for forming angled holes in a turbine diaphragm, the method comprising:

determining the amount of cooling air needed to cool components aft of the diaphragm;

sizing a radius for the angled holes to allow all or a portion of the determined amount of cooling air to pass through the angled holes;

selecting an angle for the angled holes;

sizing a labyrinth seal clearance to allow the determined amount of cooling air not passing through the angled holes to pass through the labyrinth seal; and forming the angled holes in the diaphragm.

* * * * *